US010920652B2

(12) United States Patent
MacDonald

(10) Patent No.: US 10,920,652 B2
(45) Date of Patent: Feb. 16, 2021

(54) COOLANT PUMP FOR AN INTERNAL COMBUSTION ENGINE

(71) Applicant: Ford Global Technologies, LLC, Dearborn, MI (US)

(72) Inventor: Benjamin MacDonald, Essex (GB)

(73) Assignee: Ford Global Technologies, LLC, Dearborn, MI (US)

( * ) Notice: Subject to any disclaimer, the term of this patent is extended or adjusted under 35 U.S.C. 154(b) by 658 days.

(21) Appl. No.: 15/647,420

(22) Filed: Jul. 12, 2017

(65) Prior Publication Data

US 2019/0017429 A1 Jan. 17, 2019

(51) Int. Cl.

| | |
|---|---|
| ***F01P 5/10*** | (2006.01) |
| ***F01P 3/02*** | (2006.01) |
| ***F04D 13/02*** | (2006.01) |
| ***F04D 13/06*** | (2006.01) |
| ***F04D 29/60*** | (2006.01) |
| ***F04D 1/00*** | (2006.01) |

(52) U.S. Cl.

CPC ..... *F01P 5/10* (2013.01); *F01P 3/02* (2013.01); *F04D 1/00* (2013.01); *F04D 13/02* (2013.01); *F04D 13/06* (2013.01); *F04D 29/605* (2013.01); *F01P 2005/105* (2013.01); *F01P 2050/22* (2013.01)

(58) Field of Classification Search

CPC ..... F01P 5/10; F01P 3/02; F01P 2005/105; F01P 2050/22; F04D 1/00; F04D 13/02; F04D 13/06; F04D 29/605

USPC ..... 123/41.44

See application file for complete search history.

(56) References Cited

U.S. PATENT DOCUMENTS

| | | | | |
|---|---|---|---|---|
| 3,091,182 | A * | 5/1963 | Anderson | F04D 29/445 415/197 |
| 3,162,136 | A * | 12/1964 | Clary | F04D 29/426 415/203 |
| 3,967,915 | A * | 7/1976 | Litzenberg | F04D 13/0606 415/211.1 |
| 4,076,450 | A * | 2/1978 | Ross | F04D 1/006 415/197 |
| 4,155,333 | A * | 5/1979 | Maggiorana | F01P 5/10 123/41.44 |
| 5,522,701 | A | 6/1996 | Nicklas et al. | |
| 6,152,691 | A | 11/2000 | Thut | |
| 9,057,385 | B2 * | 6/2015 | Burgess | F04D 29/4286 |

* cited by examiner

*Primary Examiner* — Hung Q Nguyen
*Assistant Examiner* — Anthony Donald Taylor, Jr.
(74) *Attorney, Agent, or Firm* — Brooks Kushman P.C.; Geoffrey Brumbaugh

(57) ABSTRACT

An engine is provided with a cylinder block and a pump cover cooperating to define a volute chamber for a coolant pump. An impeller is connected to a drive shaft and positioned within the volute chamber. An insert is positioned within the volute chamber directly adjacent to a cutwater along a portion of the outer wall, with the insert positioned between the cutwater and the impeller. A method is provided where, in response to pre-determining a first coolant pump displacement, a first impeller is positioned within a volute chamber defined by a block and a cover. In response to pre-determining a second coolant pump displacement being less than the first displacement, an insert is affixed along the wall adjacent to the cutwater and a second impeller is positioned within the chamber.

19 Claims, 6 Drawing Sheets

COOLANT PUMP FOR AN INTERNAL COMBUSTION ENGINE

TECHNICAL FIELD

Various embodiments relate to a pump for an engine system in a vehicle.

BACKGROUND

Internal combustion engines often include cooling systems that provide coolant flow through passages formed in the engine block. The cooling system has a pump to drive coolant flow through the system, and the pump is often mechanically driven by the crankshaft or other rotating component of the engine. The pump used with the cooling system may be a centrifugal pump that includes an impeller within the pump chamber to drive the fluid through the pump.

SUMMARY

In an embodiment, an engine is provided with a cylinder block and a pump cover cooperating to define a volute chamber for a coolant pump therebetween. The volute chamber defines an outer wall extending circumferentially about a first axis and having a cutwater adjacent to an outlet. An impeller is connected to a drive shaft and positioned within the volute chamber for rotation about a second axis, with the second axis offset from the first axis. An insert is positioned within the volute chamber directly adjacent to the cutwater and extending along a portion of the outer wall, the insert positioned between the cutwater and the impeller.

In another embodiment, a method is provided. In response to pre-determining a first coolant pump displacement, a first impeller is positioned within a volute chamber defined by an engine cylinder block and a cover and having an outer wall with a cutwater adjacent to an outlet. In response to pre-determining a second coolant pump displacement being less than the first displacement, an insert is affixed along the wall adjacent to the cutwater and a second impeller is positioned within the chamber.

DETAILED DESCRIPTION

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
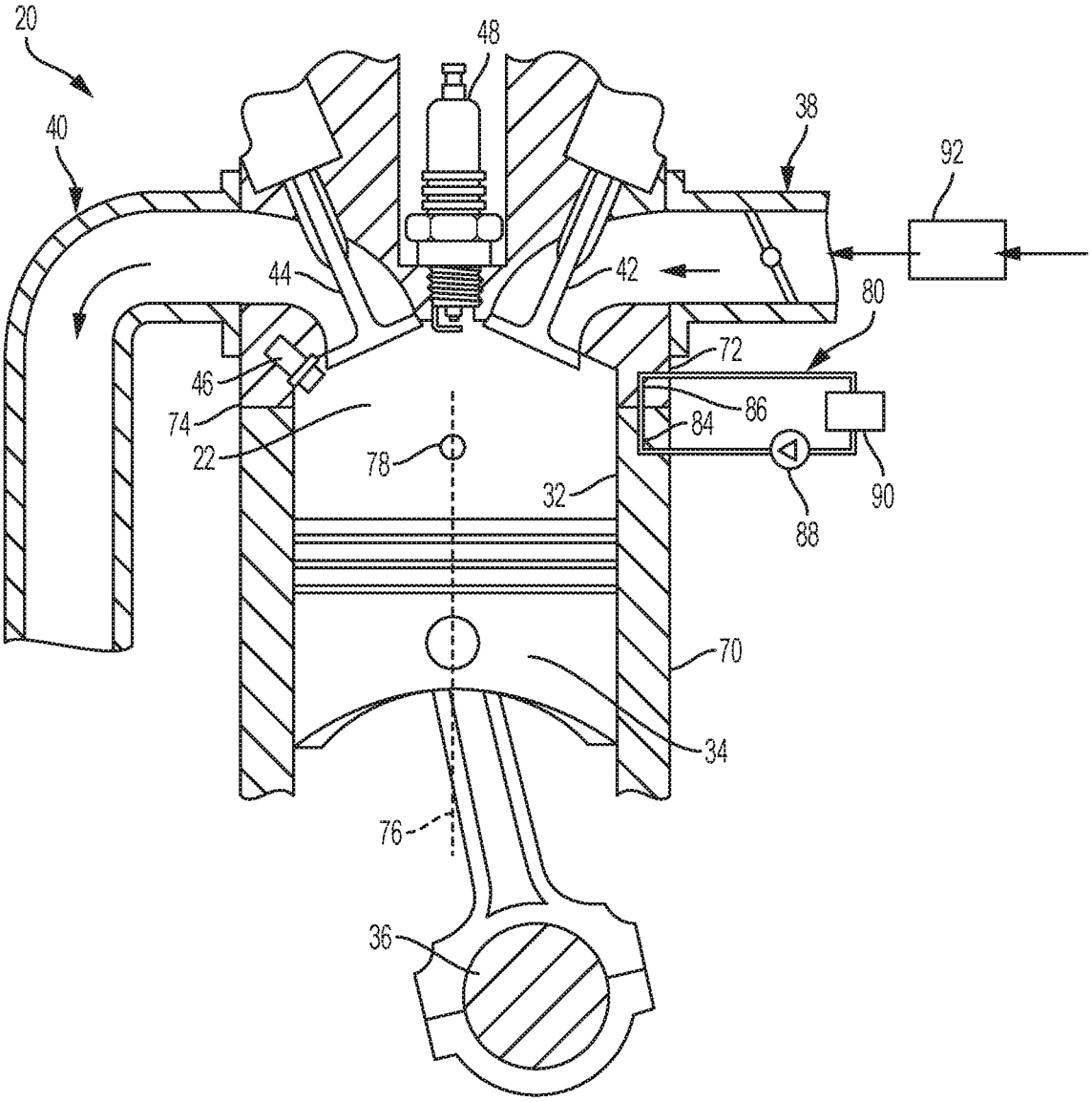
FIG. 1 illustrates a schematic of an internal combustion engine configured to implement various embodiments according to the present disclosure.

FIG. 1 illustrates a schematic of an internal combustion engine 20. The engine 20 has a plurality of cylinders 22, and one cylinder is illustrated. The engine 20 may have any number of cylinders, and the cylinders may be arranged in various configurations. The engine 20 has a combustion chamber associated with each cylinder 22. The cylinder 22 is formed by cylinder walls 32 and piston 34. The piston 34 is connected to a crankshaft 36. The combustion chamber and cylinder 22 is in fluid communication with the air intake system 38 or intake manifold 38 and the exhaust manifold 40. An intake valve 42 controls flow from the intake manifold 38 into the combustion chamber and cylinder 22. An exhaust valve 44 controls flow from the combustion chamber and cylinder 22 to the exhaust manifold 40. The intake and exhaust valves 42, 44 may be operated in various ways as is known in the art to control the engine operation.

A fuel injector 46 delivers fuel from a fuel system directly into the cylinder 22 such that the engine is a direct injection engine. A low pressure or high pressure fuel injection system may be used with the engine 20, or an intake port injection system may be used in other examples. An ignition system includes a spark plug 48 that is controlled to provide energy in the form of a spark to ignite a fuel air mixture in the cylinder 22. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, the exhaust system, and the like. Engine sensors may include, but are not limited to, an oxygen sensor in the exhaust manifold 40, an engine coolant temperature sensor, an accelerator pedal position sensor, an engine manifold pressure (MAP) sensor, an engine position sensor for crankshaft position, an air mass sensor in the intake manifold 38, a throttle position sensor, an exhaust gas temperature sensor in the exhaust manifold 40, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber.

Fuel is then introduced into the combustion chamber and cylinder 22 and ignited. In the engine 20 shown, the fuel is injected into the chamber and is then ignited using spark plug 48. In other examples, the fuel may be ignited using compression ignition.

During the expansion stroke, the ignited fuel air mixture in the combustion chamber expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber by reducing the volume of the cylinder 22. The exhaust gases flow from the cylinder 22 to the exhaust manifold 40 and to an after treatment system such as a catalytic converter.

The intake and exhaust valve 42, 44 positions and timing, as well as the fuel injection timing and ignition timing may be varied for the various engine strokes. Additionally, the engine may be used with different pistons, connecting rods, and crankshaft to provide a shorter or longer stroke, thereby changing the displacement of the engine.

The engine 20 has a cylinder block 70 and a cylinder head 72 that cooperate with one another to form the cylinders 22. A head gasket or other sealing member may be positioned between the block 70 and the head 72 to seal the cylinder 22. The cylinder block 70 has a block deck face that corresponds with and mates with a head deck face of the cylinder head 72 along part line 74, and the head gasket may be positioned therebetween.

The engine 20 includes a fluid system 80 such as a cooling system to remove heat from the engine 20. In another example, the fluid system 80 may additionally act as a lubrication system to lubricate engine components.

For a cooling system 80, the amount of heat removed from the engine 20 may be controlled by a cooling system controller or the engine controller. The system 80 may be integrated into the engine 20 as one or more cooling jackets. The system 80 has one or more cooling circuits that may contain water or another coolant as the working fluid. In one example, the cooling circuit has a first cooling jacket 84 in the cylinder block 70 and a second cooling jacket 86 in the cylinder head 72 with the jackets 84, 86 in fluid communication with each other. The block 70 and the head 72 may have additional cooling jackets. Coolant, such as water, glycol, or another liquid medium, in the cooling circuit 80 and jackets 84, 86 flows from an area of high pressure towards an area of lower pressure.

The fluid system 80 has one or more pumps 88. In a cooling system 80, the pump 88 provides fluid in the circuit to fluid passages in the cylinder block 70 and to the head 72. The cooling system 80 may be a parallel flow, split flow, parallel-split flow, or other cooling arrangement. The cooling system 80 may also include valves and/or thermostats (not shown) to control the flow or pressure of coolant, or direct coolant within the system 80. The cooling passages in the cylinder block 70 may be adjacent to one or more of the combustion chambers and cylinders 22. Similarly, the cooling passages in the cylinder head 72 may be adjacent to one or more of the combustion chambers and cylinders 22, and the exhaust ports for the exhaust valves 44. Fluid flows from the cylinder head 72 and out of the engine 20 to a heat exchanger 90 such as a radiator where heat is transferred from the coolant to the environment.

In various embodiments, the engine 20 may include a forced induction device 92 in the air intake system. The forced induction device may be a turbocharger, a supercharger, or other device that pressurizes the intake air above the air pressure available when the engine is naturally aspirated. In other examples, the engine may be provided without the forced induction device 92 such that the engine operates as a naturally aspirated engine.

Figure 2:
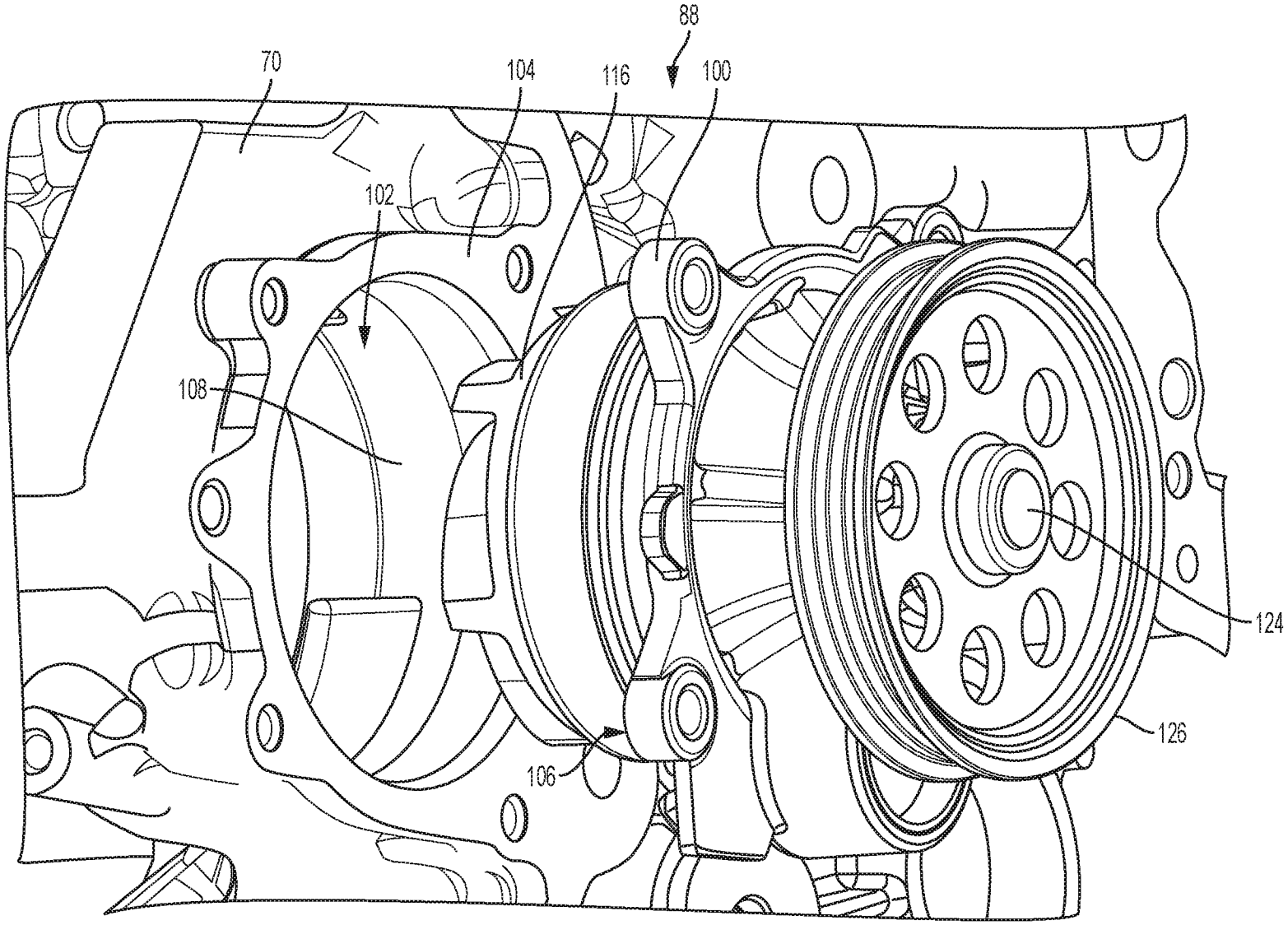
FIG. 2 illustrates a partial exploded view of a cylinder block and coolant pump according to an embodiment.

FIG. 2 illustrates a partial exploded perspective view of a cylinder block 70 and associated cooling pump 88 according to an embodiment. A portion of the engine block 70 is shown, as well as a pump 88 for the engine cooling system 80. The cylinder block 70 and pump 88 may be used with the engine 20 as described above. The pump 88 operates with reference to the example shown in FIG. 3. Elements that are the same as or similar to elements shown FIG. 1 are given the same reference numbers for simplicity.

The pump 88 is fluidly connected to an inlet passage for one or more cooling jackets for the engine to provide coolant thereto for thermal management of the engine. The cylinder block 70 and a pump cover 100 cooperate to define a volute chamber 102 or pumping chamber for the pump, and cooperate with one another to seal the volute chamber.

In one example, the volute chamber 102 is defined by a recessed region in the block 70 that is surrounded by the mounting face 104 of the block, as shown in FIG. 2. The pump cover 100 mates with the mounting face 104 surrounding the recessed region to enclose the volute chamber 102. The mounting face 104 may be provided on a side of the engine block 70, for example, that is adjacent to and at an angle with respect to the deck face 74. In one example, the mounting face 104 is approximately ninety degrees relative to the block deck face.

The pump cover 100 has a mounting face 106 that is configured to mate with the mounting face 104 of the block. Fasteners such as bolts or the like may be used to connect the pump cover to the block. Sealing members, such as gaskets, O-rings, and the like may also be provided between the mounting faces 104, 106.

The pump 88 is a centrifugal pump. In one example, as shown, the pump 88 is a single stage centrifugal pump. In other examples, the pump 88 may be a two stage centrifugal pump.

The volute or volute chamber 102 is defined by an outer wall 108 extending circumferentially about a first axis 110 and has a cutwater 112 adjacent to a pump outlet 114. The outer wall 108 may be provided at a constant distance, or substantially constant distance given various cutouts, etc., from the first axis 110.

An impeller 116, or first impeller 116, is supported by the pump cover 100 and the block 70 for rotation within the volute chamber 102. The impeller 116 rotates about a second axis 118, where the second axis 118 is offset from the first axis 110, or is parallel to the first axis 110. For example, the second axis 118 is positioned between the first axis 110 and the cutwater 112, such that the impeller 116 is closer to the cutwater 112 than to the wall 108 of the volute chamber 102 opposite to the cutwater 112.

The impeller 116 has an eye 120 and a series of vanes or ribs 122. The pump 88 may be mechanically driven, and in the present example, a shaft 124 that drives the impeller 116 is supported by the pump cover 100 and is mechanically connected to the crankshaft 36 of the engine, for example via a wheel 126, such that the impeller 116 is driven by the crankshaft. The shaft 124 may rotate about axis 118. The pump 88 may be mechanically connected to the crankshaft 36 via a belt mechanism that includes pulleys or gears in sized selected based on a desired range of operation for pump speeds. In other examples, the impeller 116 of the pump 88 may be electrically driven, for example using an electric motor connected to the pump drive shaft 124, either directly or via wheel 126 or a similar mechanism.

The eye 120 provides a suction inlet to the pump 88. Fluid flows into the pump 88 though the eye 120 of the impeller 116. The impeller 116 has a series of vanes or ribs 122 and may be an open, semi-open, or closed impeller design. The vanes or ribs 122 may extend radially outward, backward, or forwards, and may be straight or curved. As the impeller 116 is rotated or driven, the fluid in the volute or pump chamber 102 surrounding the impeller 116 also rotates. The impeller 116 forces the coolant to move radially outwards in the volute 102.

The coolant flows out of the volute 102 via a discharge passage or outlet passage 114. The cutwater 112 is provided at an entrance region to the discharge passage 114. The outer wall 108 of the volute 102 increases in distance from the axis 110 from the cutwater 112 to the outlet passage 114 and along the flow direction or the rotational direction of the impeller. Note that the impeller 116 rotates counterclockwise in the example shown in FIG. 3. This increases the pressure at the discharge region 114 of the pump as the area or volume is increasing and the velocity is decreasing. As the pressure is increased at the discharge passage 114, the coolant at the eye 120 is being displaced, which causes a suction effect to draw fluid into the volute chamber 102.

The cutwater 112 acts to provide a portion of the channel or discharge passage 114 for fluid in the pump. The impeller 116 is illustrated as being off-center in the volute or pump chamber 102 such that there is a reduced clearance between an outer edge 125 of the impeller 116 at the cutwater 112 and immediately downstream than there is between the outer edge 125 of the impeller and the outer wall 108 of the rest of the volute 102. The clearance or spacing between the impeller 116 and the volute chamber wall 108 increases from the cutwater 112, around the casing, to the discharge 114, which provides the increased area to develop a pressure head.

The volute chamber 102 therefore has an outer wall 108 with a cutwater 112 adjacent to the pump outlet 114. The outer wall 108 of the volute chamber is formed such that a distance between the outer wall and an impeller axis of rotation 118, or the second axis, continually increases from the cutwater 112 circumferentially about the volute chamber to the outlet 114.

Figure 3:
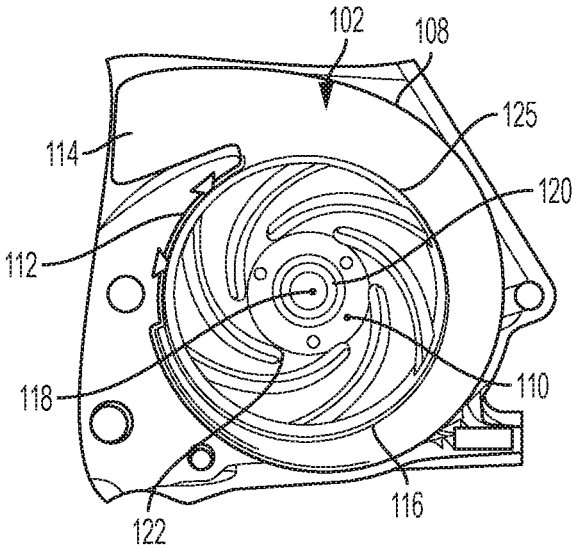
FIG. 3 illustrates a partial schematic view of the block and pump of FIG. 2 with a first impeller.

The cylinder block 70 and pump cover 100 of FIGS. 2-3 may be used with the impeller 116 as shown to deliver a first volumetric flow of coolant to the engine. Various investments are made in providing the block 70 and pump cover 100, including engineering resources and manufacturing resources. For example, the block 70 and/or pump cover 100 may be formed from a casting or molding process that requires tooling to form the component(s). The cylinder block 70 and pump cover 100 of FIG. 2 may be used with an engine 20 having different configurations, and therefore different cooling requirements, such that the coolant pump 88 has a second volumetric flow requirement for coolant to the engine that is less than the first volumetric flow.

For example, the first volumetric flow of coolant may be for the engine 20 having a forced induction intake system 92 such as a turbocharger or supercharger, while the second volumetric flow of coolant may be for the engine 20 having a naturally aspirated intake system. In another example, the first volumetric flow of coolant may be for the engine 20 having first design coolant temperature, e.g. for a commercial application, while the second volumetric flow of coolant may be for the engine 20 having a second, higher design coolant temperature, e.g. a noncommercial or passenger vehicle application. In yet another example, the first volumetric flow of coolant may be for the engine 20 having a first volumetric cylinder displacement, while the second volumetric flow of coolant may be for the engine 20 having a smaller volumetric cylinder displacement.

Impellers are sized based on the volumetric flow requirement of coolant for the engine 20. For example, operating the impeller 116 as shown in FIG. 3 at a slower speed to provide reduced flow may result in decreased pump efficiency and increased losses. By changing the diameter or size of the impeller 116, common pump components may be used, and a common drive speed of the impeller may also be used for the engine 20 in various configurations with different coolant flow requirements.

Figure 4:
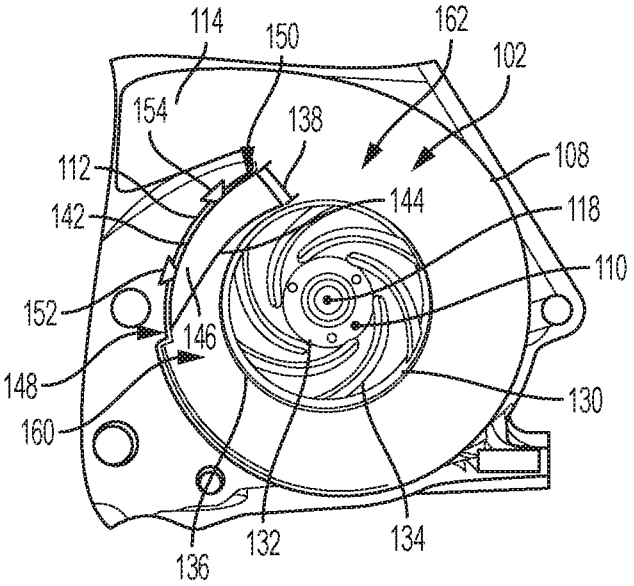
FIG. 4 illustrates a schematic view of the block and pump of FIG. 2 with a second impeller and an insert.

As such, a smaller impeller, or second impeller 130, is used to provide the reduced volumetric flow of coolant with the same volute chamber 102 as shown in FIG. 2. An example of this is illustrated in FIG. 4. In FIG. 4, the second impeller 130 is positioned within the volute chamber 102 formed by the block 70 and the pump cover 100 as described above to provide the desired predetermined flow of coolant. The second impeller 130 has a smaller diameter than the first impeller 116. The second impeller 130 is used with the same pump driveshaft 124 as the first impeller 116 such that it rotates about the second axis 118 at the same speed as the first impeller 116 would rotate. The second impeller 130 has an eye 132 and a series of ribs or vanes 134, and rotates counterclockwise in FIG. 4, such that the pump 88 operates as described above to pressurize coolant to the engine 20. As shown in FIG. 4, the outer edge 136 of the second impeller 130 is spaced apart from the cutwater 112 by a distance 138, as the size of the volute chamber 102 has not changed.

As shown in FIG. 4, an insert 140 according to the present disclosure is provided in the volute chamber 102 between the cutwater 112 and the second impeller 130 when the second impeller is used with the pump 88. Without the insert 140, a gap or space is formed between the second impeller 130 and the cutwater 112, e.g. at 138. This gap or distance is greater than a normal clearance for pump operation as is shown in FIG. 3, and would allow for bypass flow between the inlet and outlet sides of the pump 88 and volute chamber 102 if an insert is not present. In systems without an insert 140 and using a smaller impeller such as impeller 130, a trade off would be made between pump efficiency and fitment of the smaller impeller in the volute chamber. Pump efficiency is based on the power consumption of the pump 88 as the pump is a parasitic drive loss on the engine 20 and vehicle.

The insert 140 as shown in FIG. 4 is fitted in between the low pressure side 160 and the high pressure side 162 of the pump volute 102. The insert 140 provides for the second impeller 130, e.g. a smaller, lower flow, less energy consuming, impellor, to be fitted into a common volute chamber 102 and pump 88 that also is configured for use with a larger impeller 116 for higher flow applications. By preventing pressure/flow loss from the outlet side 162 to the inlet side 160 of the pump, or across the cutwater 112 region of the volute chamber 102, pumping inefficiencies may be reduced.

Referring to FIG. 4, the insert 140 is positioned within the volute chamber 102 directly adjacent to the cutwater 112 such that it extends along a portion of the outer wall 108 of the volute chamber. The insert 140 is positioned between the cutwater 112 and the second impeller 130 within the volute chamber.

The insert 140 has a first curved side wall 142 intersecting a second curved side wall 144. The first and second curved side walls 142, 144 extend between opposed sides or faces of the insert that are generally spaced as the width or depth of the volute chamber, with a first side 146 being shown. The first curved side wall 142 is shaped to mate with the outer wall 108 of the volute chamber, such that it has a radius of curvature that is substantially the same as the outer wall 108, e.g. within a few percent. The first and second curved side walls 142, 144 intersect at a first end 148 of the insert 140. As shown in FIG. 4, the length of the first curved side wall 142 from the first end 148 to the second end 150 is less than a third of a perimeter or circumference of the outer wall 108 of the volute chamber.

A distance between the first curved side wall 142 and the second curved side wall 144 continually increases from the first end 148 of the insert to a second opposed end 150 of the insert such that the first and second curved side walls 142, 144 are spaced apart from one another at the second end 150. The second curved wall 144 may have the same radius of curvature as the first side wall 142, or may have a different radius of curvature. In one example, the radius of curvature of the second side wall 144 is less than the radius of curvature of the first side wall 142. In further examples, the radius of curvature of the second side wall 144 may vary along the length of the insert 140 such that, at the first end 148 of the insert, the second side wall approaches a smooth or tangential transition from the adjacent outer wall 108 of the volute 102.

The second end 150 of the insert 140 is positioned adjacent to the cutwater 112, and may be aligned with the cutwater 112. The second end 150 of the insert 140 may have various shapes, including a taper, to provide improved flow control of coolant into the outlet 114. For example, the second end 150 of the insert may extend upstream and away from the cutwater 112 to act as an extension of the cutwater 112 and discharge passage 114 for the pump 88 with the second impeller 130.

In one example, the insert 140 is connected to or coupled to the outer wall 108 of the volute chamber 102 defined by the block 70. In another example, the insert 140 is connected to or coupled with the pump cover 100 such that it is inserted into the volute chamber 102 with the impeller 130 when the pump cover 100 is assembled to the block 70. The insert 140 does not require a fluid tight connection with the wall 108 of the volute chamber; however, a closer fit of the insert 140 with the wall 108 of the volute chamber results in increased pump efficiencies.

For example, the insert 140 may have locating features 152 that correspond and mate with locating features 154 on the block 70 or pump cover 100 to angularly fix the insert 140 within the volute chamber 102, or prevent angular movement of the insert. These locating features 152, 154 may include a dovetailing structure, or other similar structures. In another example, the insert 140 may be connected to the pump cover 100 or the block 70 using an adhesive material. In other examples, the insert 140 may be connected to the pump cover 100 using one or more fasteners. The structure of the volute chamber 102, block 70, and pump cover 100 may fix the insert 140 against radial movement or translational movement of the insert 140 relative to the volute 102 during pump 88 operation.

In one example, as shown in FIGS. 2-4, the block 70 is formed as a metal casting with the volute chamber 102 cast into the block. The impellers 116, 130 and insert 140 may be formed from a plastic material such as a thermoplastic. In one example, the first and second impeller 116, 130 and the insert 140 are formed from a high performance thermoplastic with temperature stability and chemical resistance, and in a further example, is provided as polyphenylene sulfide (PPS).

Figure 5:
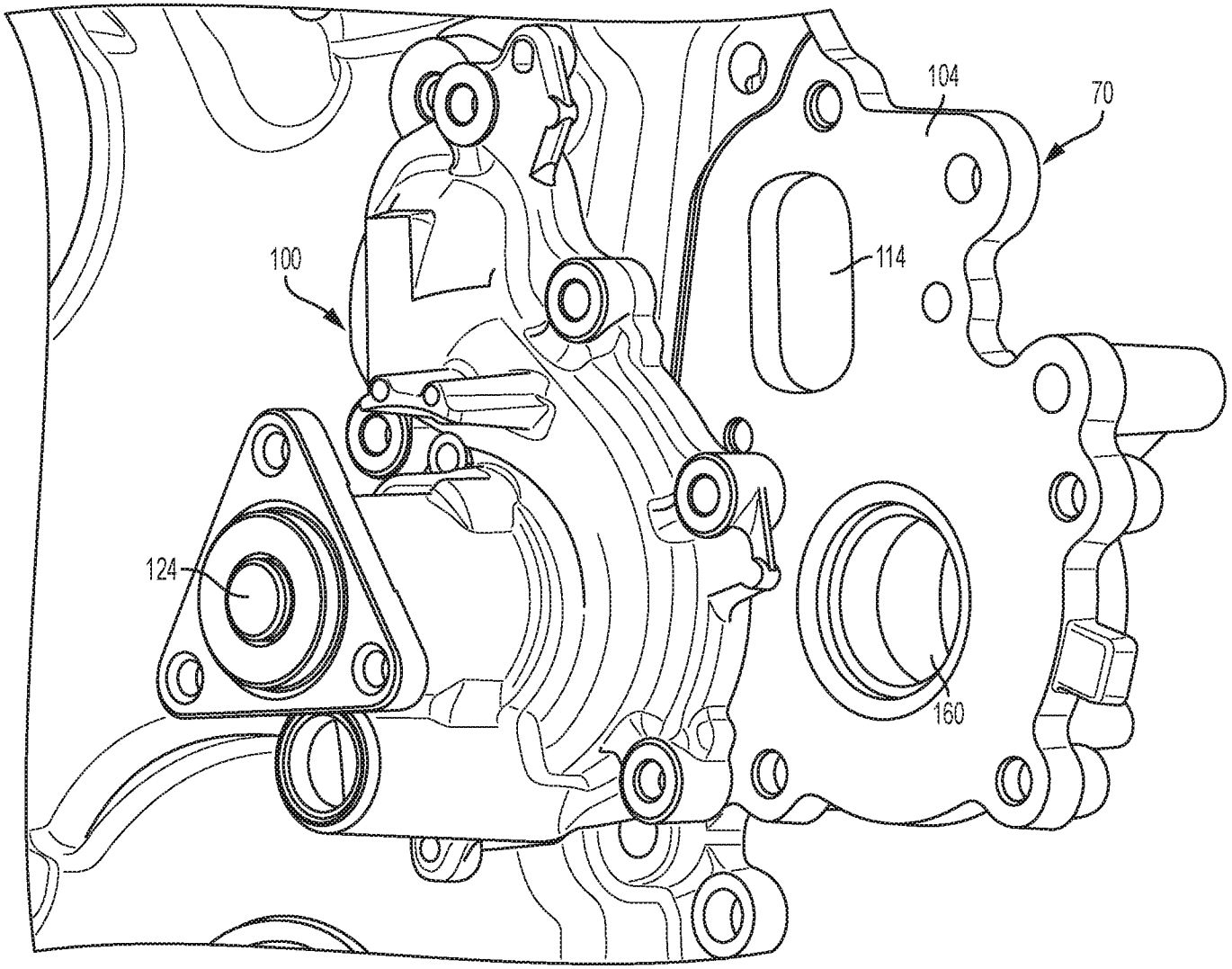
FIG. 5 illustrates a partial exploded view of a cylinder block and coolant pump according to another embodiment.
Figure 6:
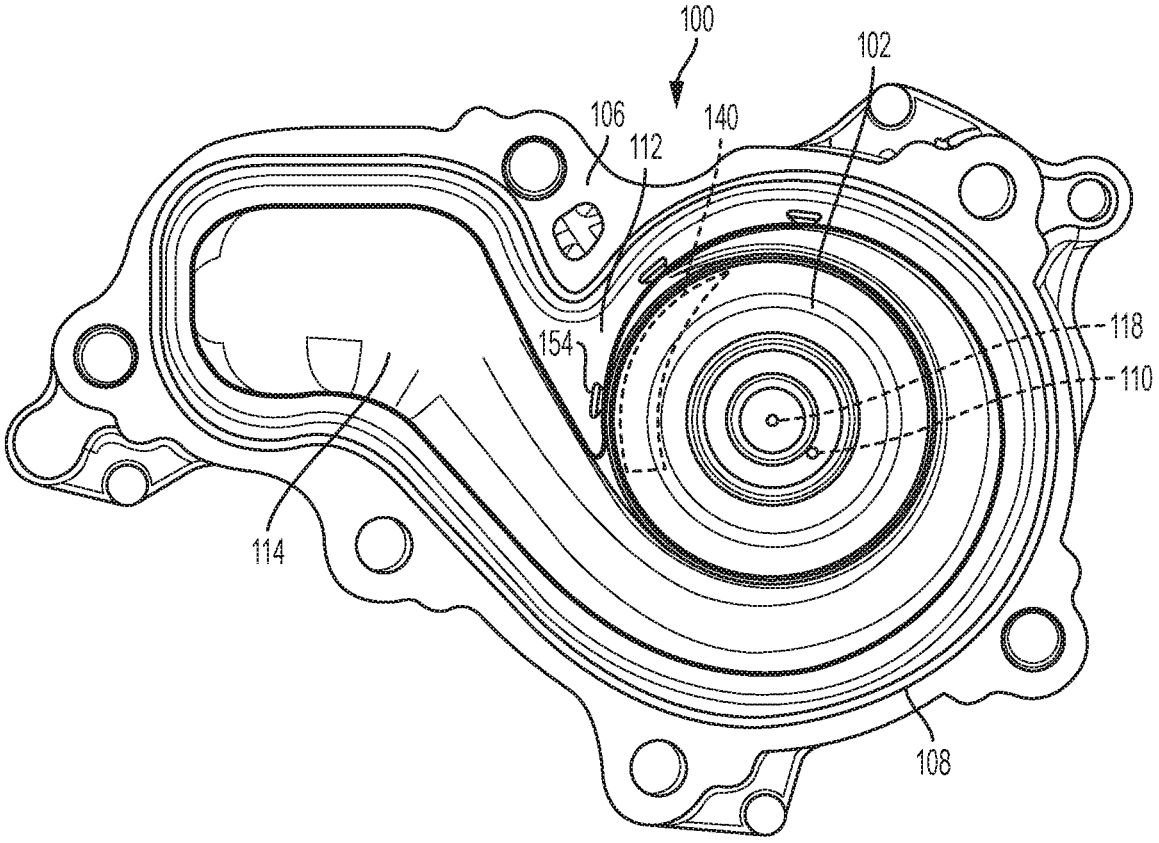
FIG. 6 illustrates a plan view of the pump cover of FIG. 5.

In another example, as shown in FIGS. 5-6, the wall 108 and cutwater 112 of the volute chamber 102 is formed by a recess in the pump cover 100. For simplicity, reference numbers for the elements shown in FIG. 5-6 are the same as those used above in FIGS. 1-4 for the same or similar elements.

FIG. 5 illustrates a partial exploded perspective view of a cylinder block 70 and associated cooling pump 88 according to an embodiment. A portion of the engine block 70 is shown, as well as a pump cover 100 for the pump 88 for the engine cooling system 80. The cylinder block 70 and pump 88 may be used with the engine 20 as described above. The pump 88 operates similarly to that described above with reference to FIGS. 3 and 4.

The cylinder block 70 and a pump cover 100 cooperate to define a volute or volute chamber 102 for the pump 88, and cooperate with one another to seal the volute chamber 102.

The volute chamber 102 is defined by a recessed region in the pump cover 100 that is surrounded by the mounting face 106 of the pump cover, as shown in FIG. 6. The pump cover 100 mates with the mounting face 104 of the block to define and enclose the volute chamber 102 therebetween. The blockside mounting face 104 may be provided on a side of the engine block 70, as above with respect to FIG. 2.

As shown in FIG. 6, the pump cover 100 defines the volute chamber 102 with an outer wall 108 extending circumferentially about a first axis 110 and has a cutwater 112 adjacent to channel 114 for the pump outlet. The outer wall 108 may be provided at a constant distance from the first axis 110. The inlet 160 and outlet 114 for the pump are shown in FIG. 5 with reference to the block 70. The inlet 160 provide fluid flow to the eye of an impeller.

A first impeller, such as impeller 116, may be positioned within and supported by the pump cover 100 for rotation within the volute chamber 102, as described above with respect to FIG. 3, with the impeller 116 rotating about a second axis 118 offset from the first axis 110.

Alternatively, a second impeller 130 and an insert 140 may be positioned within and supported by the pump cover 100 for rotation within the volute chamber 102, as described above with respect to FIG. 4, to provide a reduced volumetric flow of coolant to the engine 20 at the same pump shaft 124 speed. The insert 140 is illustrated in broken lines within the pump cover 100 as shown in FIG. 6. The insert 140 as illustrated in FIG. 6 may be connected to the pump cover 100 as shown, or may be connected to the block 70, as described above, to provide increased pumping efficiency with use of the second impeller 130.

Figure 7:
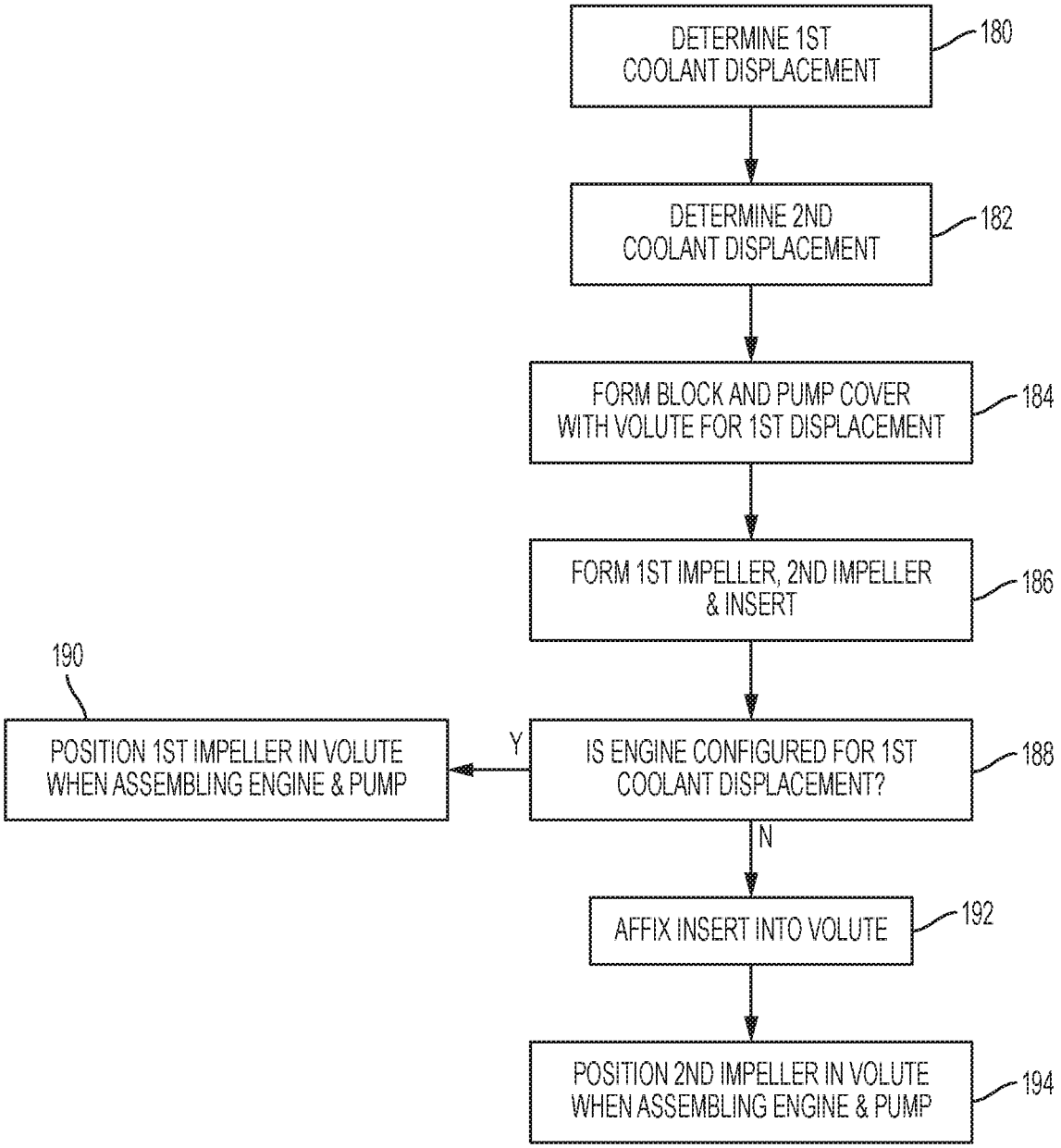
FIG. 7 illustrates a flow chart of a method of forming an engine according to an embodiment.

A method of providing an engine assembly is illustrated in the flow chart of FIG. 7 according to an embodiment. The method may include a greater or fewer number or steps than shown, and steps may be rearranged or provided in another order.

At step 180, a first displacement or first volumetric flow rate for a coolant pump 88 is predetermined for an engine 20 in a first configuration.

At step 182, a second displacement or second volumetric flow rate for the coolant pump 88 is predetermined for the engine 20 in a second configuration.

The first coolant pump displacement and the second coolant pump displacement are a function of a predetermined coolant pump 88 flow rate for the engine 20, where the predetermined coolant pump flow rate is in turn based on or is a function of the engine 20 configuration. In one example, the first coolant pump displacement is determined based on planned assembly of the cylinder block 70 and pump 88 into a naturally aspirated engine, and the second coolant pump displacement is determined based on planned assembly of the cylinder block 70 and pump 88 into a forced induction engine. In another example, the first coolant pump displacement is determined based on the cylinder block 70 and pump 88 being used with an engine 20 having a first coolant temperature threshold, and the second coolant pump displacement is determined based on the cylinder block 70 and pump 88 being used with the engine having a second coolant temperature threshold greater than the first coolant temperature threshold.

At step 184, the engine block 70, the pump cover 100, and the first impeller 116 are sized to provide a volute chamber 102 and pump 88 to provide the first displacement or first volumetric flow at a first rotational speed of the pump drive shaft 124. The block 70 of the engine 20 and the pump cover 100 are then formed to define a volute chamber 102 therebetween, for example, using a casting process.

The volute chamber 102 is defined by the engine cylinder block 70 and the pump cover 100, and may be provided as described above with respect to FIGS. 2-6 with an outer wall 108 and a cutwater 112 adjacent to the pump outlet 114. In one example, the outer wall 108 of the volute chamber is cast into the block 70. In another example, the outer wall 108 of the volute chamber is formed or defined by a surface of the cover 100.

The first impeller 116 is sized and formed with a first diameter such than an outer edge 125 of the impeller is adjacent to the cutwater 112. The second impeller 130 and the insert 140 are sized and formed such that the second impeller 130 has a second diameter that is less than the first diameter of the first impeller 116. The second impeller 130 and insert 140 are sized to fit within the volute chamber 102 and provide the second pump displacement at the first rotational speed of the pump drive shaft 124. Note that the first impeller 116 and the insert 140 do not simultaneously fit within the volute chamber 102.

At step 186, the first impeller 116, the second impeller 130, and the insert 140 are formed. The impellers 116, 130 and the insert 140 may be formed using a molding process. In a further example, only the first impeller 116 may be formed in a batch run for use with the engine 20 in the first configuration. Alternatively, only the second impeller 130 and the insert 140 may be formed in a batch run for use with the engine 20 in the second configuration. The insert 140 is formed with a first curved side wall 142 intersecting a second curved side wall 144, as described above with reference to FIGS. 2-6. The first side wall 142 is shaped to mate with the outer wall 108 of the volute chamber.

If the engine 20 is in the first configuration and a first pump displacement is indicated, the method proceeds from block 188 to block 190 and the first impeller 116 is positioned within the volute chamber 102 during assembly of the engine and pump.

If the engine 20 is in the second configuration and a second pump displacement is indicated, the method proceeds from block 188 to blocks 192, 194 and the second impeller 130 is positioned within the volute chamber 102, and the insert 140 is affixed along the wall 108 adjacent to the cutwater 112 during assembly of the engine 20 and pump 88. In one example, the insert 140 may be affixed to the outer wall 108 of the volute 102 adjacent to the cutwater 112 when the volute 102 is formed primarily by the block 70 or the cover 100. In another example, the insert 140 may be affixed to the pump cover 100 such that the insert 140 is along the wall 108 adjacent to the cutwater 112 when the cover and block are assembled such that the insert 140 is received by a volute 102 formed by the block 70.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A method comprising:

providing an engine cylinder block and a pump cover that cooperate to define a volute chamber for a coolant pump therebetween;

positioning a first impeller within the volute chamber in response to pre-determining a first coolant pump displacement, the first coolant pump displacement being based on a planned assembly of the engine cylinder block into a naturally aspirated engine; and affixing an insert along an outer wall of the volute chamber adjacent to a cutwater of the coolant pump and positioning a second impeller within the volute chamber in response to pre-determining a second coolant pump displacement being less than the first coolant pump displacement, the second coolant pump displacement being based on a planned assembly of the engine cylinder block into a forced induction engine.

2. The method of claim 1, wherein the outer wall of the volute chamber is formed such that a distance between the outer wall of the volute chamber and an impeller axis of rotation continually increases from the cutwater circumferentially about the volute chamber to an outlet of the coolant pump.

3. The method of claim 1, further comprising forming the first impeller with a first diameter such that an outer edge of the first impeller is adjacent to the cutwater.

4. The method of claim 3, further comprising forming the second impeller with a second diameter, the second diameter being less than the first diameter.

5. The method of claim 1, wherein the insert includes a first curved side wall and a second curved side wall that intersects the first curved side wall, the first curved side wall shaped to mate with the outer wall of the volute chamber.

6. The method of claim 1, further comprising casting the outer wall of the volute chamber in the engine cylinder block.

7. The method of claim 1, further comprising forming the outer wall of the volute chamber as a surface of the pump cover.

8. The method of claim 1, wherein the first coolant pump displacement and the second coolant pump displacement are each a function of a predetermined coolant pump flow rate for the engine cylinder block.

9. The method of claim 1, further comprising forming the outer wall of the volute chamber to extend circumferentially about a first axis, wherein one of the first impeller and the second impeller is affixed within the volute chamber to rotate about a second axis, the second axis being offset from the first axis and located at least partially between the first axis and the cutwater.

10. The method of claim 1, wherein the insert is affixed within the volute chamber directly adjacent to the cutwater and extended along a portion of the outer wall of the volute chamber such that the insert is positioned between the cutwater and the second impeller.

11. The method of claim 1, wherein the insert is affixed directly to the engine cylinder block.

12. The method of claim 1, wherein the insert is affixed directly to the pump cover.

13. The method of claim 5, wherein the insert is formed such that the first and second curved side walls intersect at a first end of the insert such that a distance between the first curved side wall and the second curved side wall continually increases from a first end of the insert to a second opposing end of the insert, wherein the outer wall of the volute chamber and each of the first and second curved side walls have a same radius of curvature, and wherein the method further comprises affixing the insert such that the second opposing end of the insert is positioned adjacent to the cutwater.

14. The method of claim 13, wherein a length of the first curved side wall from the first end of the insert to the second opposing end of the insert is less than a third of a perimeter of the outer wall of the volute chamber.

15. The method of claim 1, wherein the volute chamber and the outer wall of the volute chamber are defined by a recessed region in the pump cover, a mounting face of the pump cover surrounding the recessed region and cooperating with a mounting face of the engine cylinder block to enclose the volute chamber, and wherein the insert is affixed to the engine cylinder block.

16. The method of claim 1, wherein the volute chamber and the outer wall of the volute chamber are defined by a recessed region in the engine cylinder block, a mounting face of the engine cylinder block surrounding the recessed region and cooperating with a mounting face of the pump cover to enclose the volute chamber, and wherein the insert is affixed to the pump cover.

17. A method comprising:

providing an engine cylinder block and a pump cover that cooperate to define a volute chamber for a coolant pump therebetween;

positioning a first impeller within the volute chamber in response to pre-determining a first coolant pump displacement, the first coolant pump displacement being based on the engine cylinder block being used in an engine having a first design coolant temperature; and affixing an insert along an outer wall of the volute chamber adjacent to a cutwater of the coolant pump and positioning a second impeller within the volute chamber in response to pre-determining a second coolant pump displacement being less than the first coolant pump displacement, the second coolant pump displacement being based on the engine cylinder block being used in an engine having a second design coolant temperature greater than the first design coolant temperature.

18. A method comprising:

providing an engine cylinder block and a pump cover that cooperate to define a volute chamber for a coolant pump therebetween;

positioning a first impeller within the volute chamber in response to pre-determining a first coolant pump displacement, the first coolant pump displacement being based on a first engine configuration; and affixing an insert along an outer wall of the volute chamber adjacent to a cutwater of the coolant pump and positioning a second impeller within the volute chamber in response to pre-determining a second coolant pump displacement being less than the first coolant pump displacement, the second coolant pump displacement being based on a second engine configuration, wherein the insert includes a first curved side wall and a second curved side wall that intersects the first curved side wall, the first curved side wall shaped to mate with the outer wall of the volute chamber such that a distance between the first curved side wall and the second curved side wall continually increases from a first end of the insert to a second opposing end of the insert, and wherein the outer wall of the volute chamber and each of the first and second curved side walls have a same radius of curvature, and a length of the first curved side wall from the first end of the insert to the second opposing end of the insert is less than a third of a perimeter of the outer wall of the volute chamber.

19. The method of claim 18, wherein the first curved side wall of the insert forms a first locating feature with a dovetailing structure, and wherein the insert is affixed such that the first locating feature cooperates with a second locating feature defined by the outer wall of the volute chamber, the second locating feature having a corresponding dovetailing structure.

* * * * *